United States Patent [19]

Brois et al.

[11] 4,409,114

[45] Oct. 11, 1983

[54] HYDROGEN SULFIDE SUPPRESSANT ADDITIVE FOR FUNCTIONAL FLUIDS

[75] Inventors: Stanley J. Brois, Westfield; Antonio Gutierrez, Mercerville; Jack Ryer, East Brunswick, all of N.J.

[73] Assignee: Exxon Research & Engineering Co., Florham Park, N.J.

[21] Appl. No.: 405,266

[22] Filed: Aug. 4, 1982

[51] Int. Cl.[3] ..... C10M 3/32; C10M 3/48

[52] U.S. Cl. ..... 252/75; 252/33.6; 252/42.7; 252/46.4; 252/49.7; 252/77; 260/429 R; 260/429.9; 260/438.1; 260/438.5 R; 260/439 R

[58] Field of Search ..... 252/33.6, 42.7, 46.4, 252/49.7, 75, 77; 260/429 R, 429.9, 438.1, 438.5 R, 439 R

[56] References Cited

U.S. PATENT DOCUMENTS 3,779,928 12/1973 Schlicht ..... 252/77

4,164,473 8/1979 Carpland et al. ..... 252/42.7

*Primary Examiner*—John E. Kittle

*Assistant Examiner*—Robert A. Wax

*Attorney, Agent, or Firm*—John J. Mahon

[57] ABSTRACT

There are disclosed mineral or synthetic oil functional fluids which are suppressed in their tendency to form $H_2S$ at elevated temperatures by use of an additive of the formula

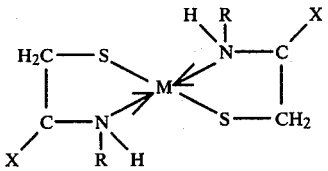

wherein X is =O or $H_2$, R is alkyl and M is a metal such as zinc.

The invention is especially useful in automatic transmission fluid compositions.

10 Claims, No Drawings

HYDROGEN SULFIDE SUPPRESSANT ADDITIVE FOR FUNCTIONAL FLUIDS

This invention relates to functional fluids, such as automatic transmission fluids, which contain an additive effective in supressing hydrogen sulfide formation, a principal cause of corrosion which results when such fluids are exposed to temperatures of about 130° F. and higher and contact metal equipment parts.

Mineral oil based power transmission shift fluids, or functional fluids, such as automatic transmission fluids are required to exhibit a number of properties such as antiwear, friction modification, oxidation inhibition, anticorrosion, demulsification and the like in order to qualify for commercial acceptance.

In accordance with the present invention there have been discovered functional fluid compositions comprising a major amount of a mineral or synthetic oil of lubricating viscosity and an oil soluble additive present in an amount effective to suppress the tendency of said fluids at elevated temperatures of about 130° F. and higher to form hydrogen sulfide, the additive being a compound of the formula:

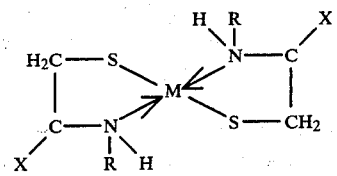

wherein R is $C_{10}$–$C_{24}$ alkyl, M is a metal of the group consisting of zinc, iron, coper, nickel, molybdenum and chromium, X is $H_2$ or an oxo (=O) group and the→ represent covalent coordination bonds between the nitrogen atom and the metal.

The preferred compunds are those of the foregoing formula where M is zinc, R is a $C_{12}$–$C_{18}$ tertiary alkyl group derived from a tertiary-alkyl primary amine and X is a =O group.

These preferred compounds may be prepared by heating together equimolar quantities of a primary amine, such as t-dodecyl primary amine, and mercaptoacetic acid in a volatile solvent such as xylene at about 120°–150° C. to form an amide intermediate, stripping off water and adding zinc acetate and refluxing to form the compound useful in the composition of the present invention. Compounds of the present invention where X is $H_2$ may be prepared in a simple reaction step involving two reactants, e.g., the product of 2-mercapto ethylalkyl amine and zinc acetate will give the following embodiment

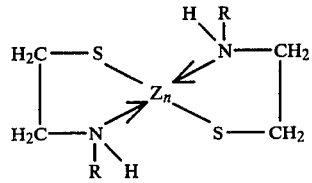

wherein R is the alkyl group of the 2-mercapto ethyl alkyl amine, $HSCH_2CH_2NHR$.

The compositions of the present invention may contain the additive generally within the range of about 0.05 to 10 wt % to provide the effective $H_2S$ suppressing activity. The exact amount used is a function of the fluid being stabilized against $H_2S$ formation and the extent to which the substrate fluid will evolve $H_2S$ under service conditions. Preferably a power transmission shift fluid will contain about 0.1 to 0.5 wt % of the $H_2S$ suppressant additive of the present invention.

The additive of the present invention will function effectively as a $H_2S$ suppressant in a wide variety of synthetic and mineral oils of lubricating viscosity used as functional fluids. The term functional fluid is meant to encompass power shift transmission fluids such as automatic transmission fluids, power steering fluids, heavy duty pressure-transmitting or hydraulic fluids, lubricating oils, gear oils, heat exchanger fluids, compressor oils, turbine oils, hydrostatic transmission oils, drilling fluids, universal tractor fluids and the like. Generally, the additives of the present invention are useful in any functional fluid composition where the formation of $H_2S$ under service conditions, typically, as a result of elevated temperatures of 130° F. and higher, will promote the corrosion of metal equipment parts which come in contact with the functional fluid. The formation of $H_2S$ in such fluids may be due to the presence of sulfur in the fluid itself or as the result of other additives required in such fluids such as anti-wear additives, extreme pressure additives, corrosion and rust inhibitors.

Examples of synthetic fluids which can be stabilized against $H_2S$ formation in accordance with the present invention are olefin oligomers, alkylated aromatics, polybutenes, cycloaliphatic compounds, dibasic acid esters and polyol esters, polyglycol fluids, phosphate esters, silicone and halogenated hydrocarbon fluids.

Automatic transmission fluids (ATF) containing the $H_2S$ suppressant in an amount of about 0.2 to 0.4 wt % additive of the present invention are the particularly preferred embodiment. Improvements in corrosion resistance of ATF has become recently of greater importance because smaller sump capacities and the increased load on a car's cooling system has increased transmission operating temperatures. Such ATF compositions contain a number of conventional additives in typical amounts as required to provide their normal attendant functions and are typically blended into the mineral oil base in the following ranges:

| Components | Concentration Range (Vol. %) |
|---|---|
| V.I. Improver | 1–15 |
| Corrosion Inhibitor | 0.01–1 |
| Oxidation Inhibitor | 0.01–1 |
| Dispersant | 0.5–10 |
| Pour Point Depressant | 0.01–1 |
| Demulsifier | 0.001–0.1 |
| Anti-Foaming Agents | 0.001–0.1 |
| Anti-Wear Agents | 0.001–1 |
| Seal Swellant | 0.1–5 |
| Friction Modifier | 0.01–1 |
| Mineral Oil Base | Balance |

Typical base oils for automatic transmission fluids and power transmission shift fluids generally include a wide variety of light hydrocarbon mineral oils, such as, naphthenic base, paraffin base and mixtures thereof, having a lubricity viscosity range of about 34 to 45 SUS (Saybolt Universal Seconds) at 38° C.

The invention is further illustrated by the following examples which are not to be considered as limitative of its scope. ATF compositions used in the examples below were formulated in accordance with the components and concentrations noted above and are referred to as Base Fluid.

$H_2S$ suppression in the following examples was measured by placing 50 ml samples of test fluid in a test tube which is heated to 300° F. in an aluminum block heater. The amount of $H_2S$ evolution is measured in the test tube utilizing lead acetate strips manufactured for this purpose which record 0–200 units (arbitrary) of $H_2S$ evolved. The quantity of units evolved over a 3 or 4 hour period at 300° F. are recorded. A conventional fully formulated ATF composition will show $H_2S$ evolution after 3 hours in excess of 200 units.

EXAMPLE 1

Additive A was prepared by reaction of tertiary-dodecyl primary amine, mercapto acetic acid and zinc acetate to provide a compound of the formula

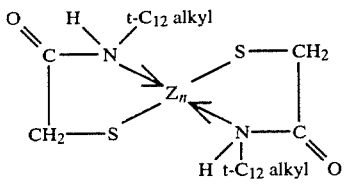

Additive B was prepared by reacting 2-mercaptoethyl decyl amine and zinc acetate to provide a compound of the formula

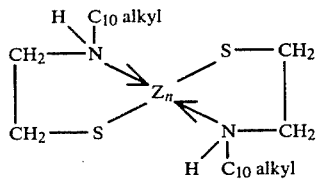

EXAMPLE 1A

Both the Base Fluid ATF and Base Fluid with 0.4 wt % of Additive A were evaluated in the $H_2S$ suppression tests with these results after 3 hours at 300° F.:

| | |
|---|---|
| Base Fluid | 200 units $H_2S$ |
| Base Fluid + Additive A | 0 units $H_2S$ |

A copper strip was placed in each fluid tested and evaluated after 5 hours at 170° C. with the following results:

| | Appearance | mg. Cu loss |
|---|---|---|
| Base Fluid | Grey | 4.1 |
| Base Fluid + Additive A | Shiny | 2.8 |

This test confirms the corrosion inhibition benefits associated with $H_2S$ suppression.

EXAMPLE 1B

The $H_2S$ test was repeated with Additive B at 4 hours at 300° F. and the results were the same: 200 units for the Base Fluid and 0 units for the Base Fluid containing 0.2 wt % of Additive B.

What is claimed is:

1. A functional fluid composition comprising a major amount of a synthetic or mineral oil of lubricating viscosity containing an oil-soluble additive in an amount effective to suppress the tendency of the fluid composition at elevated temperatures to form hydrogen sulfide, the additive being a compound of the formula

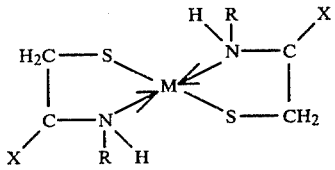

wherein R is a $C_{10}$–$C_{24}$ alkyl, M is a metal of the group of zinc, iron, copper, nickel, molybdenum and chromium and X is $—H_2$ or $=O$.

2. The composition of claim 1 wherein M is zinc.

3. The composition of claim 1 wherein X is $—H_2$.

4. The composition of claim 1 wherein R is a tertiary $C_{12}$–$C_{18}$ alkyl group.

5. The composition of claim 1 wherein X is $=O$, M is zinc and R is a tertiary $C_{12}$–$C_{18}$ alkyl.

6. The composition of claim 5 prepared by reacting a tertiary $C_{12}$–$C_{18}$ alkyl primary amine, mercaptoacetic acid and zinc acetate.

7. The composition of claim 3 wherein M is zinc and R is a $C_{10}$ alkyl.

8. The composition of claim 1 wherein the fluid is a mineral oil functional fluid.

9. The composition of claim 8 wherein the functional fluid composition is an automatic transmission fluid further containing conventional additives in typical amounts as required to provide their normal attendant functions.

10. The composition of claim 9 wherein the $H_2S$ suppressant additive is present in an amount of from about 0.1 to about 0.5 wt %.

* * * * *